US005400723A

United States Patent [19]

Okuno et al.

[11] Patent Number: 5,400,723

[45] Date of Patent: Mar. 28, 1995

[54] APPARATUS FOR WASTE INCINERATION

[75] Inventors: Satoshi Okuno; Hirotami Yamamoto; Susumu Nishikawa; Hiroki Honda; Yoshinori Terasawa, all of Yokohama, Japan

[73] Assignee: Mitsubishi Jukogyo Kabushiki Kaisha, Tokyo, Japan

[21] Appl. No.: 968,832

[22] Filed: Oct. 29, 1992

[30] Foreign Application Priority Data

Nov. 5, 1991 [JP] Japan ..... 3-288583

[51] Int. Cl.[6] ..... B09B 3/00

[52] U.S. Cl. ..... 110/235; 110/204; 110/346; 110/348

[58] Field of Search ..... 110/348, 204, 346, 246, 110/245, 235; 431/190; 432/113

[56] References Cited

U.S. PATENT DOCUMENTS

| | | | |
|---|---|---|---|
| 4,021,193 | 5/1977 | Waters . | |
| 4,056,068 | 11/1977 | Hafeli | 110/348 X |
| 4,505,230 | 3/1985 | Caplin | 110/204 X |
| 4,512,266 | 4/1985 | Shigaki | 110/204 |
| 4,639,209 | 1/1987 | Grethe | 431/190 X |
| 4,658,736 | 4/1987 | Walter . | |
| 4,957,050 | 9/1990 | Ho | 110/346 |
| 4,960,057 | 10/1990 | Ohshita et al. . | |
| 5,038,690 | 8/1991 | Kumagai et al. . | |
| 5,102,330 | 4/1992 | Ho | 110/246 X |

FOREIGN PATENT DOCUMENTS

| | | |
|---|---|---|
| 0235531 | 9/1987 | European Pat. Off. . |
| 2316542 | 1/1977 | France . |
| 2533010 | 2/1976 | Germany . |
| 3125429 | 2/1983 | Germany . |

*Primary Examiner*—Edward G. Favors
*Attorney, Agent, or Firm*—McAulay Fisher Nissen Goldberg & Kiel

[57] ABSTRACT

A method of incinerating wastes while controlling the production of dioxins wherein water vapor or water is sprayed in the main combustion zone of an incinerator. An apparatus for practicing the method of waste incineration, including a line for supplying main combustion air, either alone or together with a line for supplying recycled combustion gas, to the incinerator from below its hearth, is provided with a line for supplying water vapor or water in communication with the line or lines.

2 Claims, 9 Drawing Sheets

APPARATUS FOR WASTE INCINERATION

FIELD OF THE INVENTION AND RELATED ART STATEMENT

The present invention relates to a method of incinerating wastes from environmental facilities and products and an apparatus therefor, and more particularly to a method for low-pollution (limited dioxin production) incineration of domestic refuses, industrial wastes, sewage, human wastes, sludges from paper industry, and other wastes such as organic compounds containing chlorine compounds and also to an apparatus therefor.

Detection of highly toxic dioxins in the flue gas, ash residue, flyash, etc. from municipal refuse incinerators is causing a growing concern these days. Investigations on the methods of analysis, the mechanism of evolution, and techniques for control of the dioxins are under way in industrial-academic circles throughout the world. Reports have been made on high-temperature combustion, retention time, etc. aimed at complete incineration. However, the data presented on the subjects are rather meager, and a breakthrough is being sought in vain.

OBJECTS AND SUMMARY OF THE INVENTION

In view of the state of art described above, the present invention has for its object to provide a low-pollution incineration method and apparatus capable of controlling the production of highly toxic dioxins upon incineration of various wastes including organic wastes that contain chlorine compounds.

The invention realizes the object by providing:

(1) A method of incinerating wastes while controlling the production of dioxins, characterized in that water vapor or water is sprayed in the main combustion zone of an incinerator; and (2) An apparatus for incinerating wastes having a line for supplying main combustion air, either alone or together with a line for supplying recycled combustion gas, to an incinerator from below the hearth thereof, characterized in that a line for supplying water vapor or water is provided in communication with said line or lines.

The invention has now been arrived at after extensive experimental studies on ways for controlling the secondary production of dioxins and decomposing any such products in consideration of the fact that they are aromatic chlorine compounds. The invention thus provides a method and an apparatus for incineration adopting a system for supplying water vapor or water to the main combustion zone of the incinerator using primary combustion air as the entraining medium.

With regard to the mechanism of formation of dioxins, reports have been made that they easily form during the thermal decomposition process of organic substances and that there are many competing reactions for their production. However, much remain to be clarified and diverse investigations have just got under way at various research institutes and laboratories.

The present inventors were interested in the fact that dioxins are aromatic (cyclic hydrocarbon) chlorine compounds and conceived of either thermally decomposing (i.e., opening) their benzene rings or preventing the formation of the rings. As a consequence, injection of water vapor or water to the main combustion zone has now been adopted. In this way decomposition of dioxins and control of dioxin production can be accomplished concurrently by thermal decomposition and combustion reactions. Thus, low-pollution incineration can be realized.

This mechanism of decomposition and control of dioxins is presumably represented by an overall reaction formula:

$$C_mH_n + mH_{20} \rightarrow mCO + (n/2+m)H_2$$

DETAILED DESCRIPTION OF PREFERRED EMBODIMENTS

Figure 1:
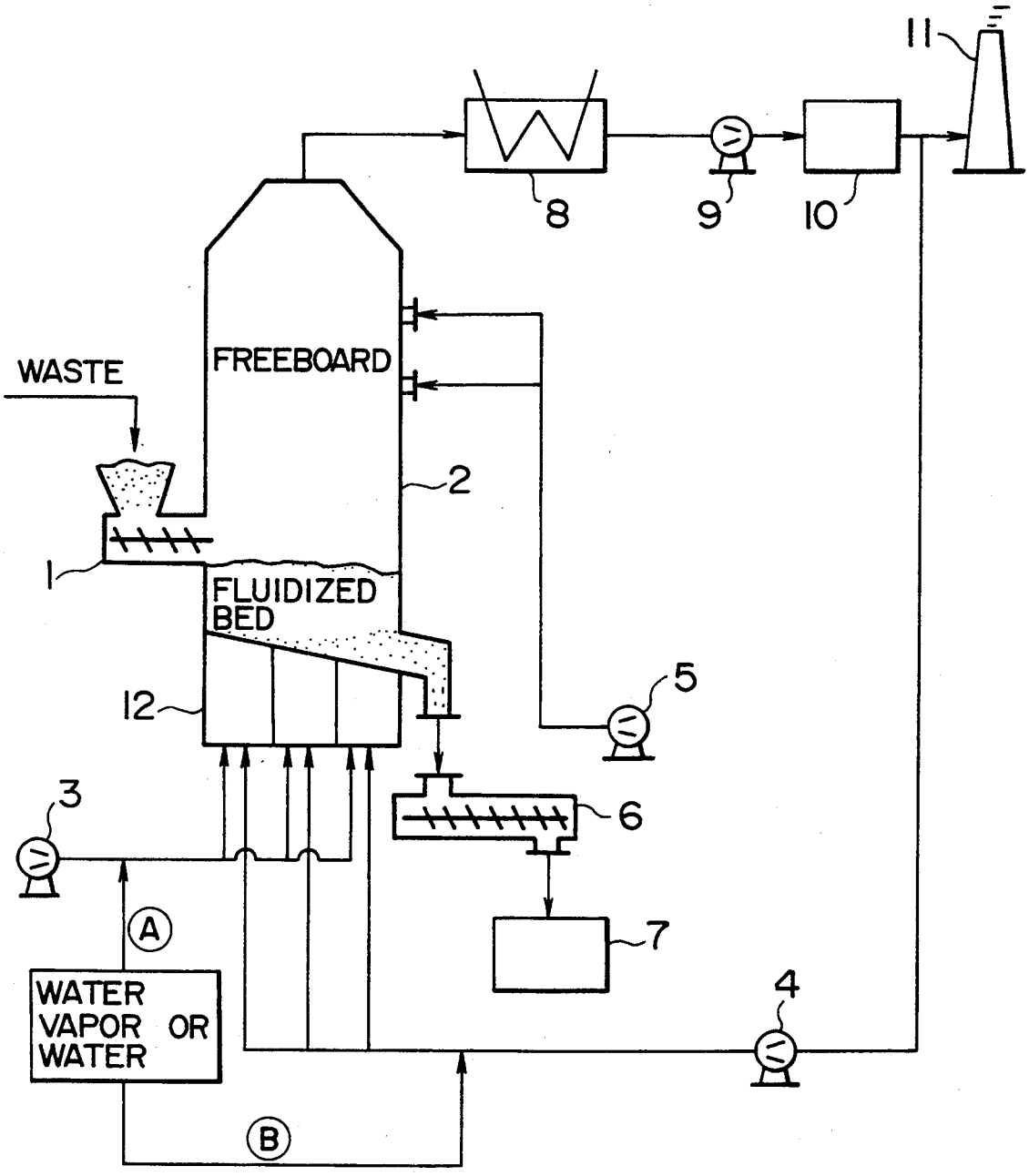
FIG. 1 is a schematic diagram of the first embodiment of the present invention as applied to a fluidized-bed incinerator.

As the first embodiment, the present invention as applied to a fluidized-bed incinerator for municipal wastes including organic wastes that contain chlorine compounds will now be described with reference to FIG. 1. In FIG. 1, the numeral 1 designates a waste feeder, 2 a fluidized-bed incinerator, 3 a fluidizing-air fan, 4 a flue gas-circulating blower, 5 a secondary-air fan, 6 an ash cooler, 7 an ash hopper, 8 a heat recoverer, 9 a flue gas fan, 10 a flue gas-treating unit, 11 a stack, and 12 a wind box assembly.

The flue gas-circulating blower 4 and secondary-air fan 5 are driven when necessary.

Water vapor or water is supplied at the points shown in FIG. 1. The construction is such that it can be injected into either (A) a fluidizing-air line or (B) a flue gas-circulating line.

Wastes to be incinerated are fed via the feeder 1 to the fluidized-bed incinerator 2. Fluidizing air (primary air) is ordinary atmospheric air supplied by the fluidizing-air fan 3. Depending on the type of wastes being handled, treated flue gas is supplied as a part of primary air by the flue gas-circulating blower 4 to the wind box assembly 12 to adjust the percentage of excess air and the fluidized state in the fluidized-bed zone. In that case multistage combustion is carried out, effecting controlled combustion (low air excess percentage combustion) in the fluidized-bed zone and combustion in the freeboard with secondary air supplied by the secondary-air fan 5.

The ash residue and other noncombustible matter that collect at the bottom of the furnace are cooled by the ash cooler 6, separated from fluidized sand, and stored in the ash hopper 7. The gas, on the other hand, is conducted through the heat recoverer 8, flue gas fan 9, and flue gas-treating unit 10, and then released from the stack 11 to the atmosphere.

In experiments with the apparatus described above, water vapor or water was sprayed over the fluidizing air to capture dioxins that are produced by the incineration of wastes containing chlorine compounds. It was confirmed that up to 99.1% of the dioxin contents was thus removed.

The amount of water, or water vapor as water, added was, in terms of the molar weight to the carbon amount in the combustibles, 0.88 ($H_2O/C$ molar ratio). The combustion temperatures were as given in Table 1. The properties of the treated gas, also shown in the table, reflected favorable low-pollution incineration.

TABLE 1

| Item | Experiment: With water added in accordance with the invention | Experiment: Without water addition as usual |
|---|---|---|
| Furnace outlet air ratio* | 1.68 | 1.62 |
| Amount of water added ($H_2O^{mol}/C^{mol}$) | 0.88 | 0 |
| Temperature inside the fluidized bed | 672° C. | 898° C. |
| Freeboard temperature | 930~1000° C. | 950~990° C. |
| Retention time at or above 850° C. | ab. 2 sec. | ab. 2 sec. |
| Furnace outlet gas composition | | |
| $O_2$ | 8.49% | 8.02% |
| $CO_2$ | 12.37% | 12.8% |
| CO | 45 ppm | 25 ppm |
| $NO_x$ | 69 ppm | 72 ppm |
| Dioxins | 60 ng/Nm$^3$ | 6500 ng/Nm$^3$ |

Figure 2:
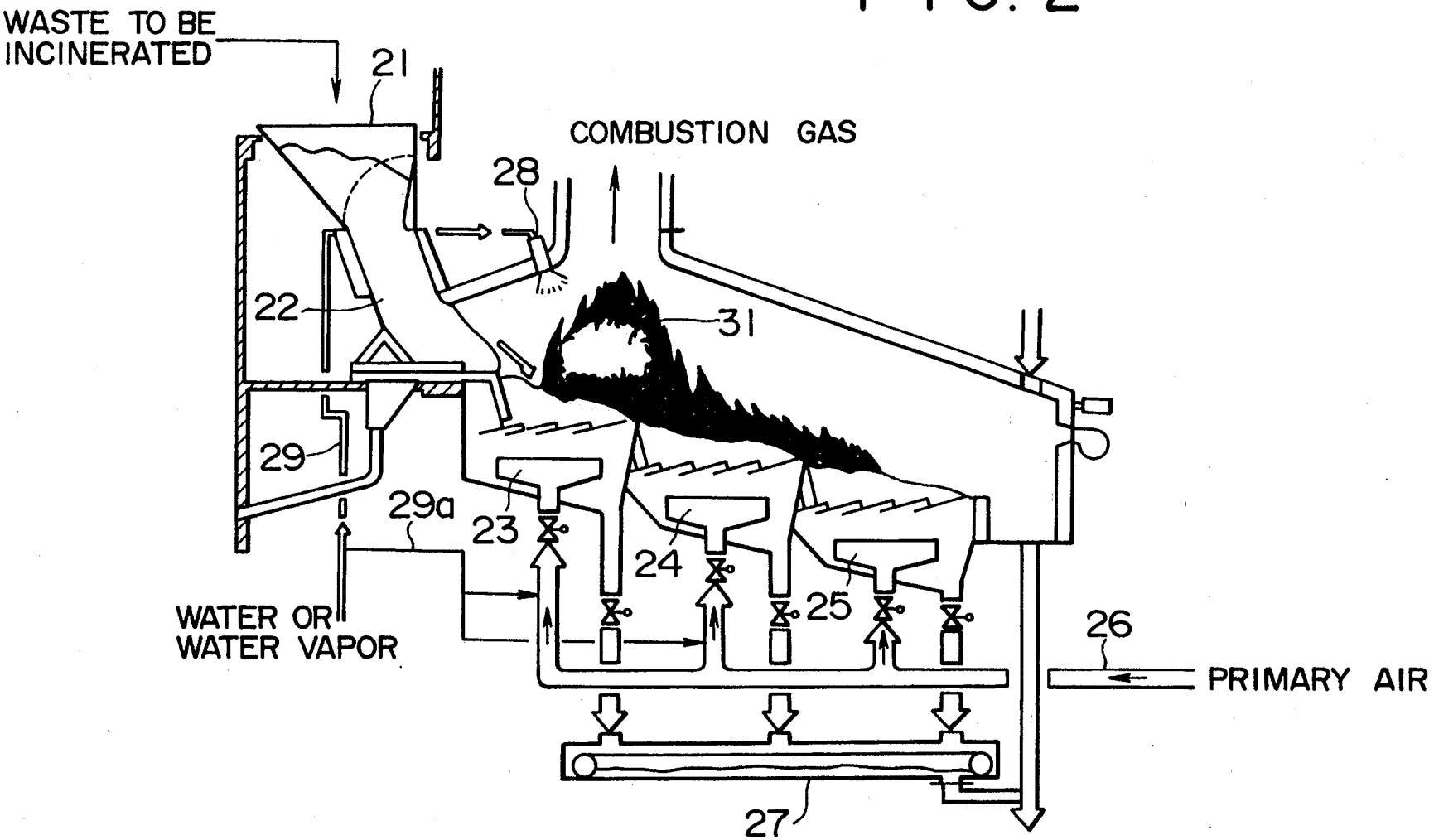
FIG. 2 is a schematic view of the second embodiment of the invention as applied to a stoker-fired incinerator.

*Furnace outlet air ratio = quantity of actually supplied air/theoretical combustion air quantity In FIG. 2 is shown the second embodiment of the invention as applied to a stoker-fired incinerator.

In the figure, 21 is a feed hopper for introducing waste to be incinerated, 22 is a feeding chute, 23, 24, 25 are a plurality of stoker units arranged stepwise, 26 is a draft line for forcing primary air into the individual stoker units, and 27 is an ash conveyor installed beneath the stoker units.

A spray nozzle 28 is provided in the upper part of the combustion chamber above the stoker and is supplied with water or water vapor by a supply line 29. A line 29*a* branches off from the line 29 into communication with the draft line 26.

Waste to be incinerated is introduced through the feed hopper 21 and feeding chute 22 into the furnace, burned by the stoker units 23, 24, 25, and discharged in the form of ash. Here water or water vapor as an agent to be injected is forced into the primary air draft line 26 or into the main combustion zone 31 above the stoker.

Figure 3:
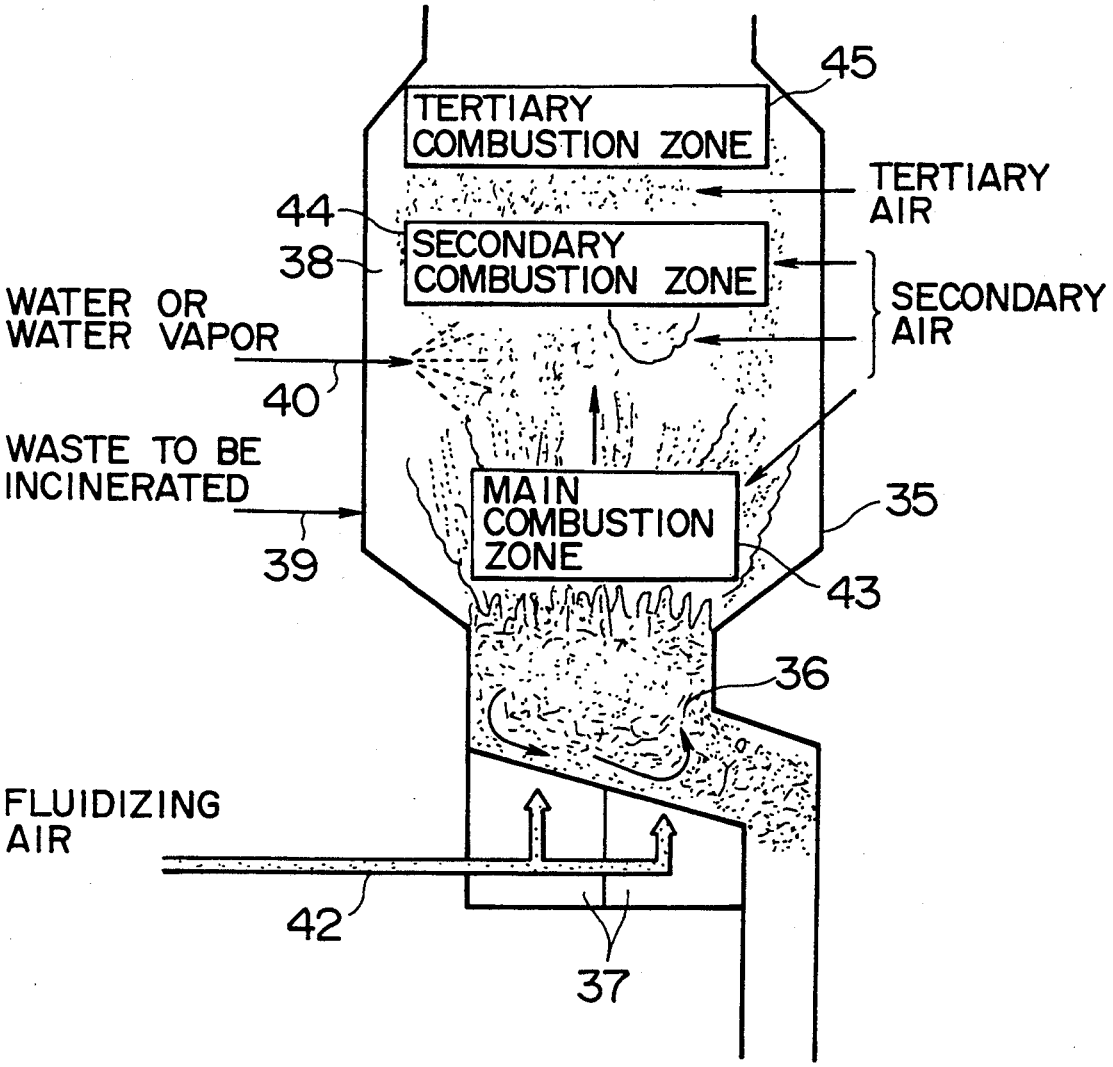
FIG. 3 is a schematic view of the third embodiment of the invention as applied to a fluidized-bed incinerator.

FIG. 3 illustrates the third embodiment of the present invention as applied to a fluidized-bed incinerator.

As shown, 35 is the main body of the incinerator, 36 a fluidized bed, 37 wind boxes, 38 a freeboard, 39 an inlet for feeding waste to be incinerated, 40 a conduit for introducing water or water vapor, and 42 an inlet pipe for supplying fluidizing air to the lower part of the fluidized bed 36.

The waste to be incinerated, fed through the inlet 39 into the incinerator body 35, is gasified by thermal decomposition in the fluidized bed 36. The resulting gas flows upward through the main combustion zone 43, secondary combustion zone 44, and tertiary combustion zone 45. Secondary air is supplied to the main and secondary combustion zones 43, 44, and tertiary air is supplied between the second and tertiary combustion zones 44, 45.

When water or water vapor is used, it is introduced into the main combustion zone 43 where apparently benzenes and phenols as precursors of dioxins are being produced.

Figure 4:
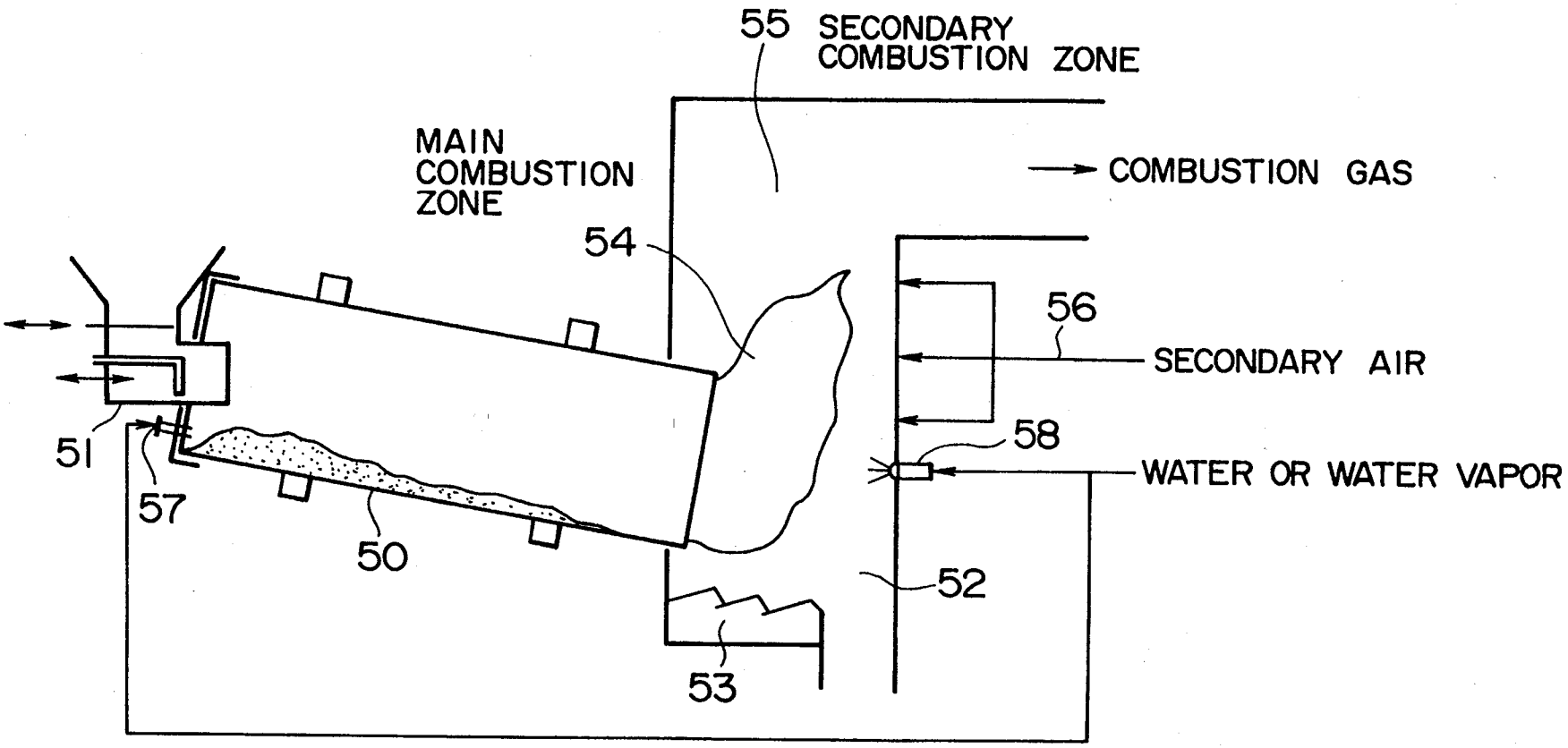
FIG. 4 is a schematic view of the fourth embodiment of the invention as applied to a rotary kiln.

FIG. 4 shows the fourth embodiment of the invention as applied to a rotary kiln.

In the figure, 50 is a rotary kiln, 51 a waste feeder, 52 a gas recombustion chamber, and 53 an after-burning stoker provided in the lower part of the recombustion chamber 52. In the recombustion chamber 52, combustion gas from a main combustion zone 54 is discharged by way of a secondary combustion zone 55. Numeral 56 indicates a line through which secondary air is supplied. Spray nozzles 57, 58 for introducing water or water vapor are mounted in end walls of the rotary kiln 50 and recombustion chamber 52, respectively.

Waste to be incinerated is fed by the feeder 51 to the rotary kiln 50. Inside the kiln 50, the waste is thermally decomposed into a gaseous form by the radiant heat from the recombustion chamber 52 at a high temperature, and then is secondarily burned in that chamber. Water or water vapor as an injection agent is either forced by the nozzle 57 directly into the decomposing-gasifying zone of the rotary kiln 50 where the precursors of dioxins are easily formed or introduced by the nozzle 58 into the main combustion zone 54.

Figure 5:
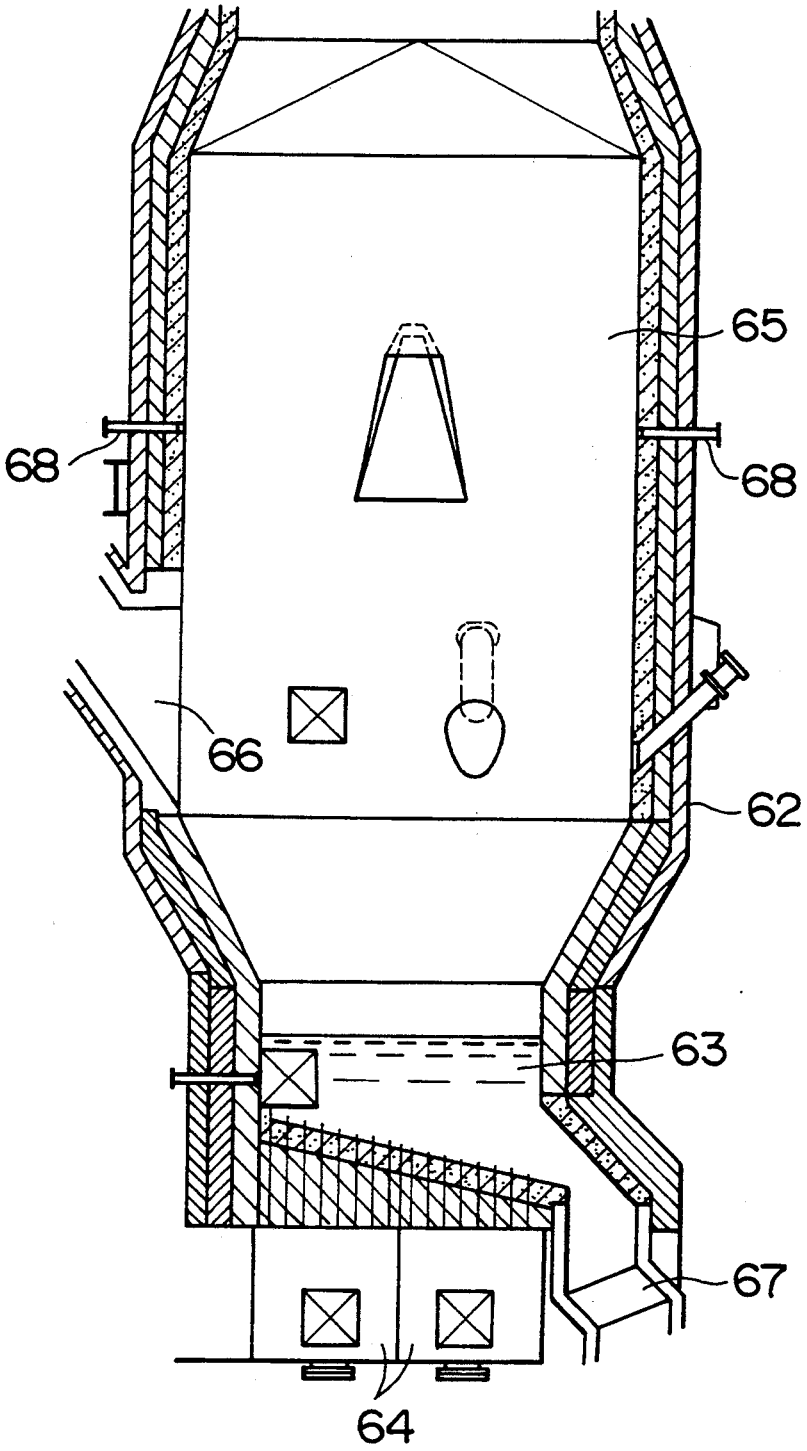
FIG. 5 is a vertical sectional view of the fifth embodiment of the invention as applied to a fluidized-bed incinerator.
Figure 6:
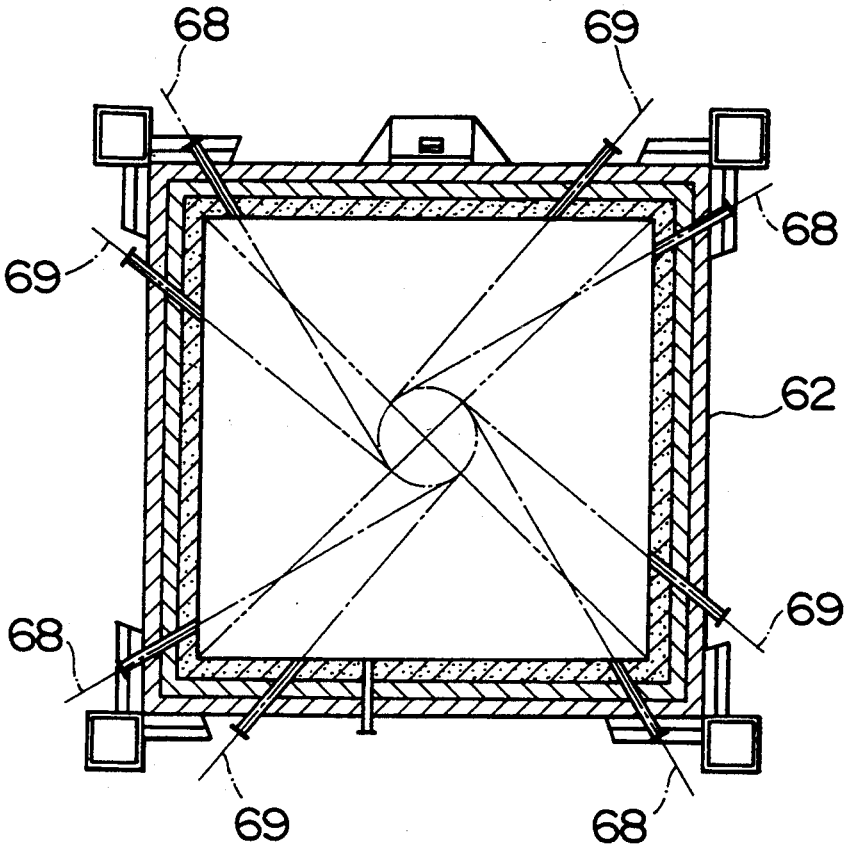
FIG. 6 is a cross sectional view of the fifth embodiment.

FIGS. 5 and 6 show the fifth embodiment of the invention as applied to a fluidized-bed incinerator, intended to clarify a typical arrangement of water spray nozzles.

Referring to the figures, 62 is the main body of the fluidized-bed furnace, 63 a fluidized bed, 64 wind boxes, 65 a freeboard, 66 a waste hopper, 67 an ash residue outlet, 68 a plurality of water spray nozzles mounted in the surrounding wall of the fluidized-bed incinerator body 62, and 69 a plurality of secondary air nozzles likewise mounted in the surrounding wall. The water spray-nozzles 68 and secondary air nozzles 69 are located with inclination at predetermined angles to the axial center of the incinerator (in a pattern represented by alternate long-and-short-dashes lines in FIG. 6) so as to produce a swirl flow in the furnace and achieve an enhanced gas-water mixing and stirring effects.

Figure 7:
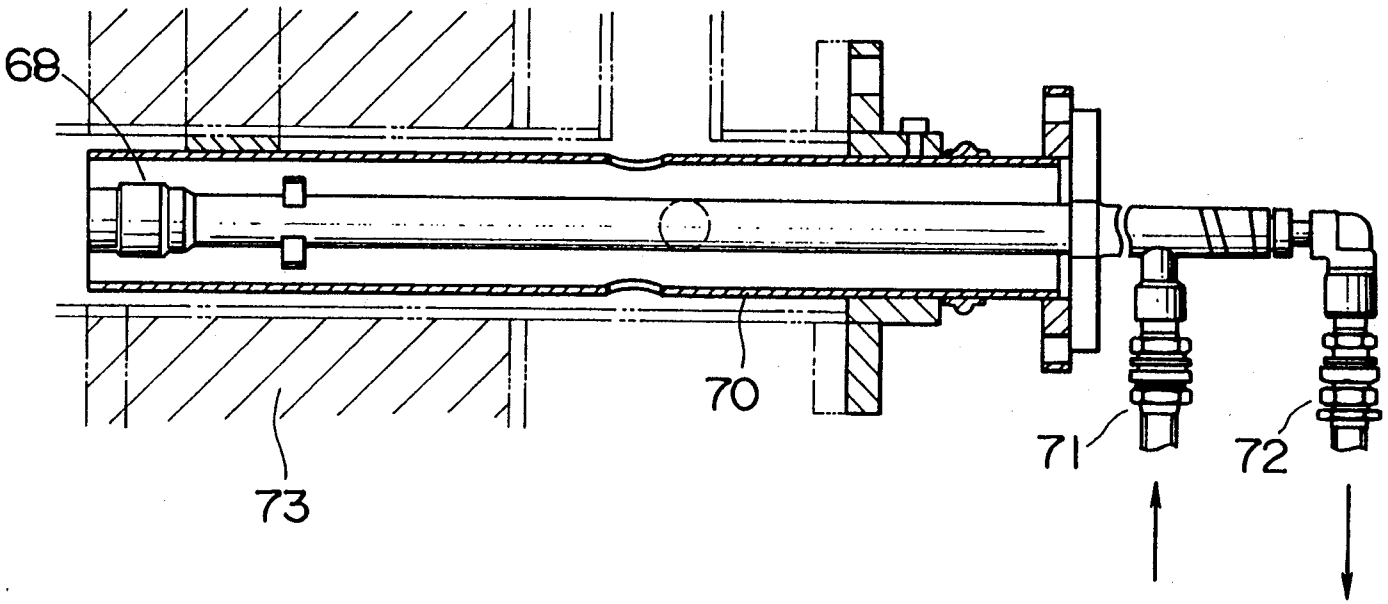
FIG. 7 is a sectional view of a water spray nozzle for use in the present invention.

FIG. 7 illustrates the construction of an embodiment of the water or water vapor spray nozzle for use in the present invention. This spray nozzle is of a type which can maintain water supply to the spray tip at the front end constant by keeping a constant water supply pressure and adjusting the return water pressure (water quantity), and hence can maintain the size of sprayed water droplets constant regardless of the flow rate. In the figure, 68 is the main body of the spray nozzle, 70 a protective sleeve, 71 an inlet pipe for introducing spray water, 72 a return pipe, and 73 a refractory wall of the furnace body. The quantity of spray issuing from the nozzle is increased or decreased by adjusting the opening of a flow regulating valve (not shown) installed downstream of the return pipe 72. In the practice of the invention water or water vapor is constantly injected at a controlled rate.

Figure 8:
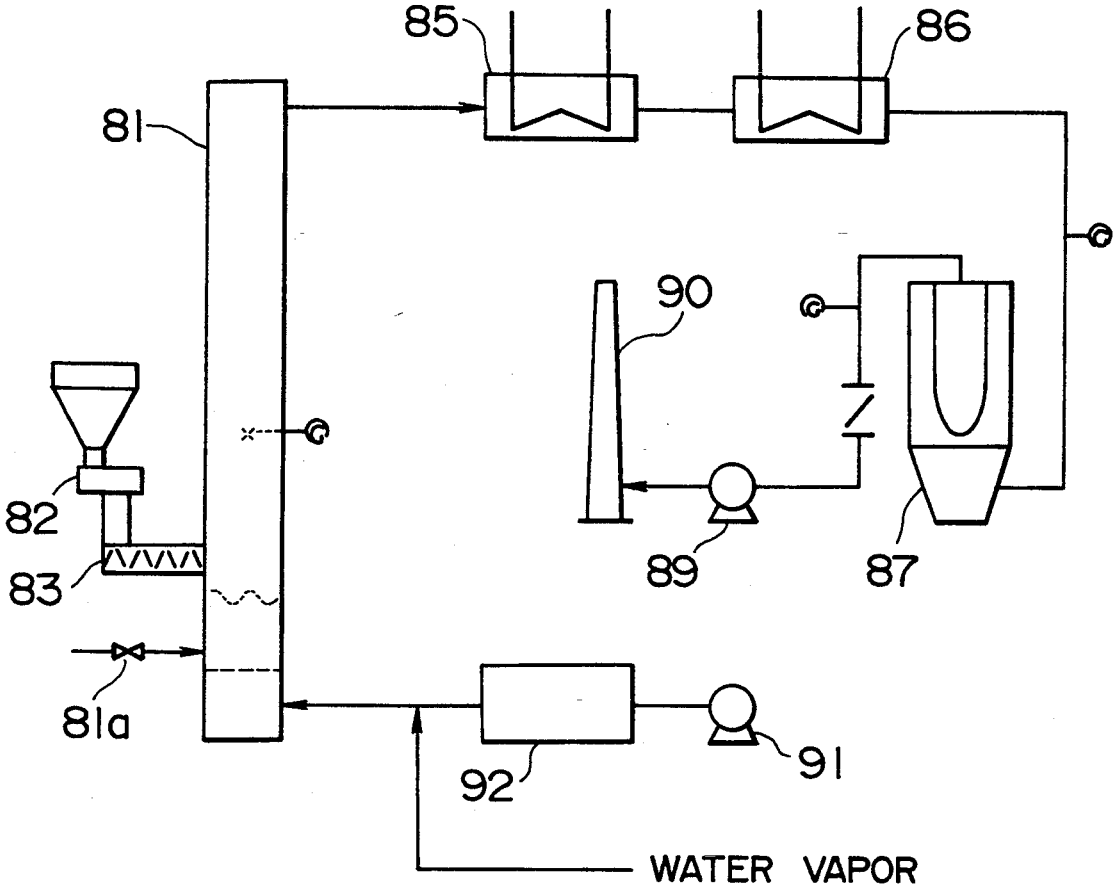
FIG. 8 is a flow chart of a testing equipment used to confirm the effects of the invention.

FIG. 8 is a flow chart of a testing equipment used to confirm the advantageous effects of the present invention. First, waste to be burned is fed to a cylindrical fluidized-bed incinerator 81 via a metering hopper 82 and a feeder 83. The combustion gas leaving the top of the furnace is cooled as it passes through two indirect air-cooled gas coolers 85, 86 in tandem. After dust removal by a bag filter 87, the cleaned gas is discharged by an induced draft fan 89 to the atmosphere via a stack 90.

Meanwhile, water vapor is used as an injection agent and is injected at a predetermined rate into primary air which is boosted in pressure by a forced draft fan 91 and heated to a given temperature by an air heater 92. For the purposes of the experiments the amounts of dioxins produced were measured at the inlet of the bag filter 87. The symbol 81*a* indicates a (propane) gas burner and G, a gas sampling point.

Figure 9:
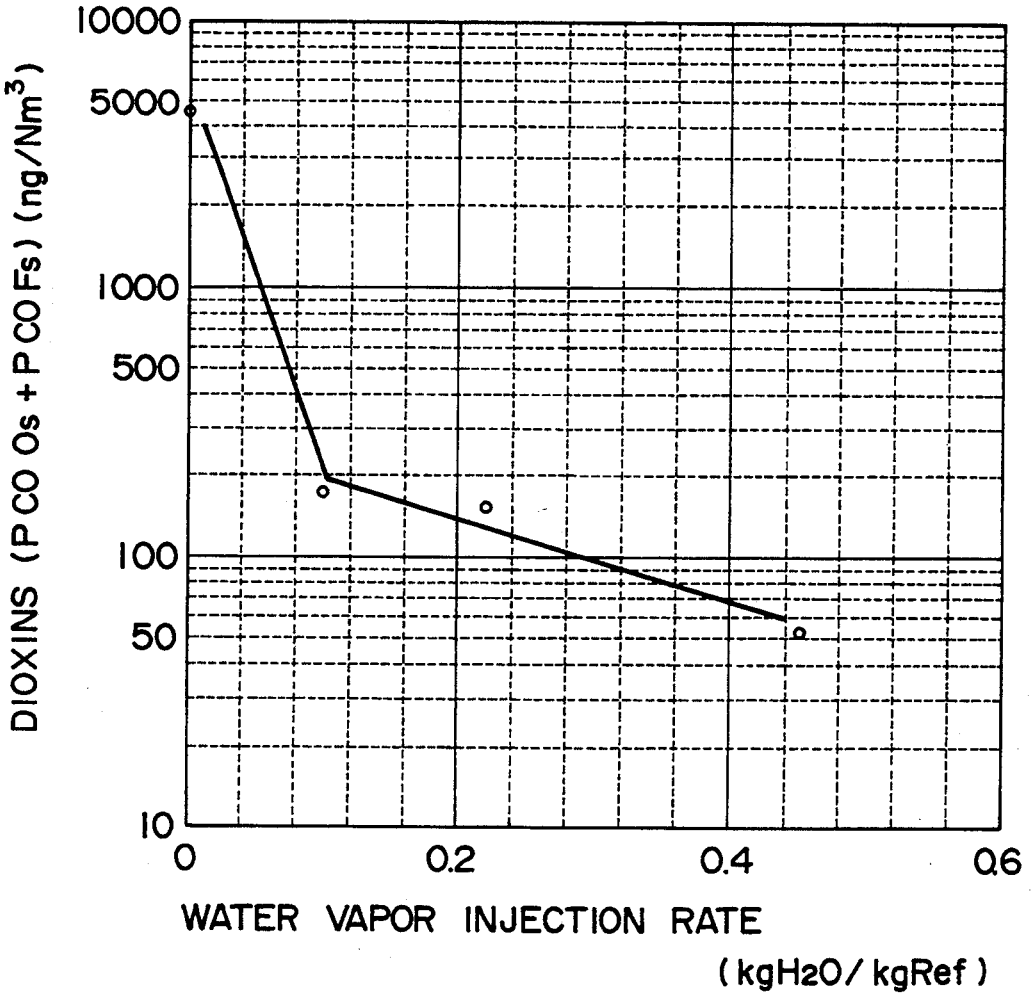
FIG. 9 is a graph showing the relation between the water vapor injection rate and the dioxins concentration.

With the testing equipment described above, experiments were made on ordinary combustion without the injection of water vapor and on combustion at varied rates of water vapor injection. Resulting concentrations of dioxins (PCDDs +PCDFs) are graphically represented in FIG. 9. As for the combustion conditions used, the fluidized-bed temperature was 700° C. and the $O_2$concentration in the combustion gas was 7%.

The water vapor injection rate was varied over the range of 0.1 to 0.46 kg $H_2O$/kg waste ($H_2O$/C molar ratio =0.2 to 0.88). The graph shows that the presence of only a small amount of water vapor reduced the overall dioxin concentration sharply, to less than one-twentieth of the concentration when no such vapor was injected. The largest injection reduced the concentration to nearly one-hundredth, indicating the amazing effect of the invention.

For the injection of water or water vapor in conformity with the invention it is only necessary to keep the injecting point at a temperature of 700° C. or upwards, decide an injection rate according to the desired dioxin reduction ratio, and inject the water or water vapor constantly at a controlled rate corresponding to the rate of incineration.

As described above, the present invention renders it possible to control or reduce markedly the secondary production of dioxins during the incineration of wastes containing chlorine compounds that is causing a global concern today. The invention thus realizes low-pollution incineration and its contribution to the protection of earth environments is unmeasurably great.

We claim:

1. In a stoker-fired incinerator having air supply lines for supplying combustion air to lower parts of individual stoker units, the improvement which comprises said incinerator having a line for supplying water vapor or water in communication with said air supply lines and a line for supplying water vapor or water in an upper part of the main combustion zone of said incinerator.

2. In an apparatus for incinerating wastes composed of an incinerator having a first line for supplying main combustion air and a second line for supplying recycled combustion gas to the incinerator from below the incinerator hearth, the improvement which comprises said apparatus having a line for supplying water vapor or water in communication with said first and second lines.

* * * * *